United States Patent [19]

Chen

[11] Patent Number: 5,046,732

[45] Date of Patent: Sep. 10, 1991

[54] STRUCTURE OF A SHOCK ABSORBING RACQUET

[76] Inventor: Dennis Chen, 293 Pei Tun Road, Taichung, Taiwan

[21] Appl. No.: 574,591

[22] Filed: Aug. 29, 1990

[51] Int. Cl.[5] ..... A63B 49/08

[52] U.S. Cl. ..... 273/73 J

[58] Field of Search ..... 273/73 R, 73 J, 75, 273/67 R

[56] References Cited

U.S. PATENT DOCUMENTS

| | | | |
|---|---|---|---|
| 1,750,644 | 3/1930 | Norton | 273/73 J |
| 2,183,925 | 12/1939 | Simpson | 273/73 J |
| 4,203,596 | 5/1980 | Nagamoto | 273/73 J |
| 4,826,167 | 5/1989 | Lo | 273/73 J |
| 4,984,793 | 1/1991 | Chen | 273/75 |

*Primary Examiner*—William H. Grieb

[57] ABSTRACT

A shock absorbing racket structure comprising a head frame, a handle, and a pair of yoke bars connecting the head frame to the handle. Wherein, the yoke bars are hollow tubular members extending through the handle to a butt plate, forming a pair of cylindrical chambers within the handle. Within each cylindrical chamber is lodged a bullet-shaped resilient body, from which extends an axial rod, on whose rear termination is attached a support plate common to both axial rods and backed by the butt plate.

3 Claims, 3 Drawing Sheets

STRUCTURE OF A SHOCK ABSORBING RACQUET

BACKGROUND OF THE PRESENT INVENTION

The present invention relates to an improved tennis racquet structure and more particularly to a shock absorbing tennis racquet.

In the game of tennis a common undesired side effect of prolonged and strenuous play is a sports injury commonly known as tennis elbow. Its primary cause is the shock generated in the head frame of a racket when a ball violently rebounds from the net.

Though many artifices have been used to reduce the shock transmitted to a player's arms and elbows, most have required changes or additions to the head frame structure. Unfortunately, there is usually a concomitant degradation of the racket's balance and handling.

In the present invention, injurious shock is absorbed at the very point where a player's body comes in contact with his racquet, namely the racquet's handle.

SUMMARY OF THE PRESENT INVENTION

The main object of the present invention is to provide a shock absorbing tennis racket structure that satisfactorily reduces the shock transmitted to a user's body without unduly affecting the racket's playing qualities.

The shock absorbing racquet structure of the present invention comprises a head frame, from which extends a pair of yoke bars, and a handle. Within each yoke bar is a hollow of oval cross-section that extends into the handle to the butt plate, forming a pair of adjacent cavities. Each cavity has a bullet shaped resilient body, in contact with the cavity walls, disposed on the end of an elongate vibration absorbing rod. The opposite ends of either vibration absorbing rod being secured to a base plate resting on the butt plate.

Whereby, shock from the head frame, passing through the yoke bars, is greatly attenuated by the action of the pair of resilient bodies and vibration absorbing rods, before reaching the user's hands.

EMBODIMENT OF THE PRESENT INVENTION

Figure 1:
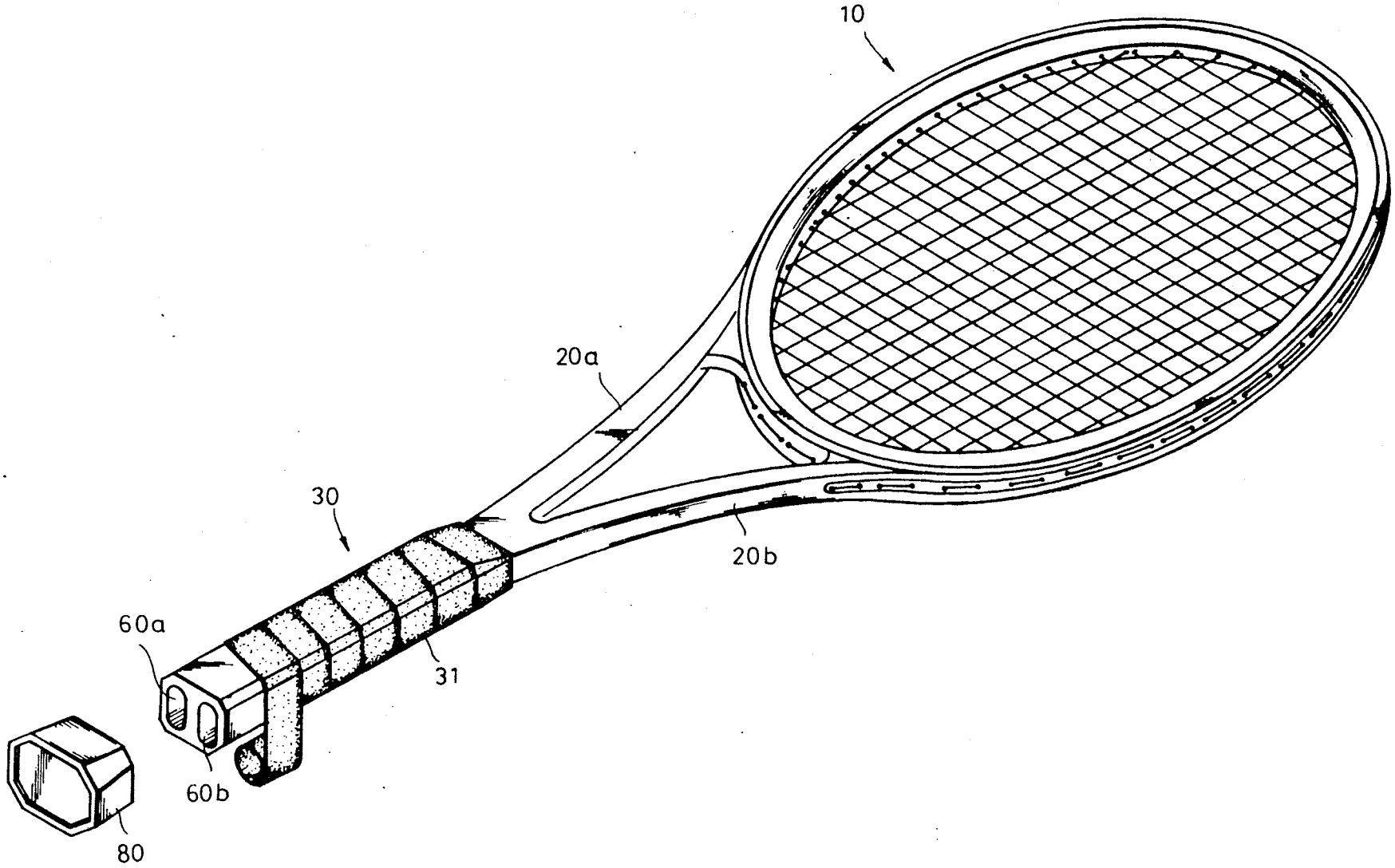
FIG. 1 is a perspective view of an embodiment of the present invention with the butt plate removed.
Figure 2:
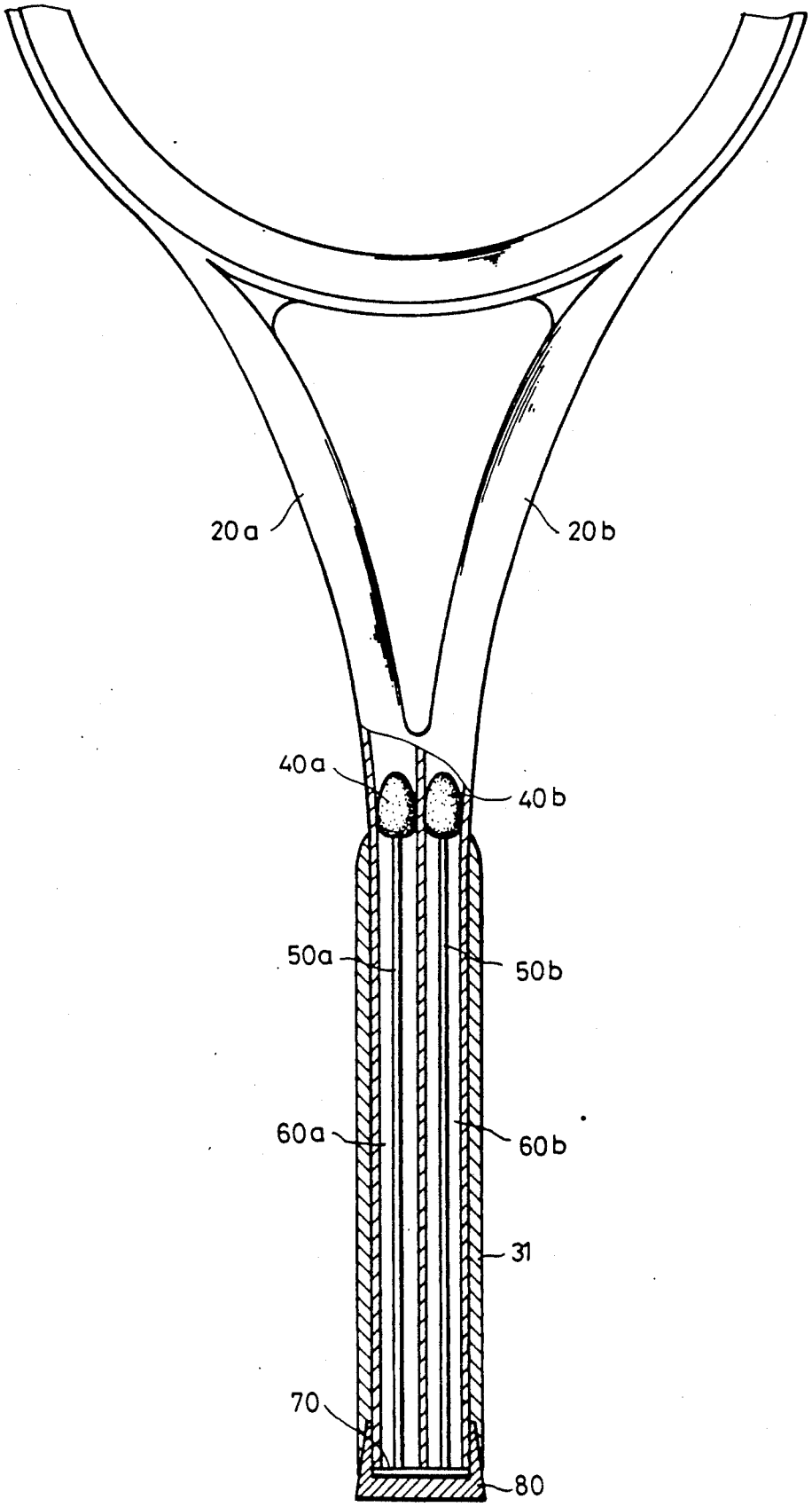
FIG. 2 is a cut away view of an embodiment of the present invention.

Referring to FIGS. 1 and 2, an embodiment of the present invention comprises a head frame 10, from which extends a pair of yoke bars, 20*a* and 20*b*, and a handle 30, which is wrapped with an adhesive tape to form a grip 31, as is explicitly shown in FIG. 1.

Within each yoke bar, 20*a* and 20*b*, is formed an oval cavity, 60*a* and 60*b*, which extend to the base of the handle.

Figure 3:
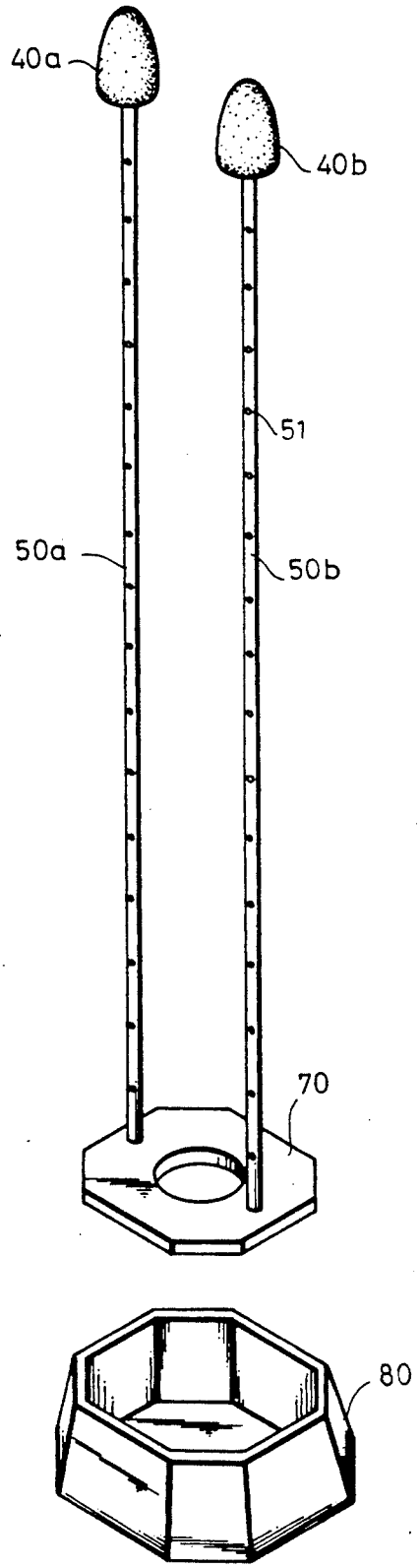
FIG. 3 is a disassembled view of the shock absorbing components of the present invention.

A pair of resilient bodies, 40*a* and 40*b*, are each disposed on the ends of a respective vibration absorbing rod, 50*a* and 50*b*, with a common base plate 70 secured to the opposite ends, as shown in FIG. 3.

Again referring to FIG. 2, the pair of resilient bodies, 40*a* and 40*b*, and vibration absorbing rods, 50*a* and 50*b*, are inserted into respective oval cavities 60*a* and 60*b*. Whereupon, the butt plate 80 is secured over base plate 70 to complete the structure of the shock absorbing racket.

The pair of resilient bodies, 40*a* and 40*b*, are in intimate contact with the walls on one side of respective oval cavities, 60*a* and 60*b*. Stresses caused by shock impulses from the head frame affect displacements of the walls of the oval cavities, 60*a* and 60*b*, which the resilient bodies, 40*a* and 40*b*, supported by vibration absorbing rods, 50*a* and 50*b*, resist. 40*b*, supported by respective absorbing rods, 50*a* and 50*b*, resist.

Shock energy imparted to the resilient bodies, 40*a* and 40*b*, is partly absorbed by hysteresis losses within the material of the bodies themselves, and partly converted to vibrational energy in the vibration absorbing rods, 50*a* and 50*b*.

With the aid of a plurality of irregular shaped perforations 51 formed along the lengths of both vibration absorbing rods 50*a* and 50*b*, vibrations are greatly attenuated before reaching the outer handle structure.

As is readily apparent from the above discussion, the present invention provides for a shock absorbing racquet structure which suffers little in weight penalty and does not affect the structure or performance of the head frame.

I claim:

1. A shock absorbing racquet structure comprising a head frame, a handle, and a pair of yoke bars extending from said head frame and concomitantly joining with said handle, wherein:

said yoke bars each have separate elongate hollow cavities that extend to the base of said handle;

a resilient body is disposed within each said hollow cavity, with one end of a vibration absorbing rod attached to and extending from each said resilient body;

a substantial portion of the outer surface of each said resilient body are in contact with the walls of respective said hollow cavities;

the ends of said vibration absorbing rods, opposite from said resilient bodies, are attached to a butt plate secured to the base of said handle.

whereby, shock transmitted from said head frame is absorbed by the action of said resilient bodies and said vibration absorbing rods.

2. A shock absorbing racquet structure as claimed in claim 1, wherein said vibration absorbing bodies are attached to a common base plate which is juxtaposed with said butt plate.

3. A shock absorbing racquet structure as claimed in claim 1, wherein a plurality of perforations are formed along the axis of said vibration absorbing bodies.

* * * * *